US005208538A

United States Patent [19]

Sakanishi et al.

[11] Patent Number: 5,208,538

[45] Date of Patent: May 4, 1993

[54] APPARATUS HAVING A PAIR OF MAGNETIC FIELD GENERATING CABLES FOR MEASURING POSITION OF AN UNDERGROUND EXCAVATOR

[75] Inventors: Shoichi Sakanishi; Kanji Shibatani, both of Hiratsuka, Japan

[73] Assignee: Kabushiki Kaisha Komatsu Seisakusho, Tokyo, Japan

[21] Appl. No.: 778,166

[22] PCT Filed: Jun. 29, 1990

[86] PCT No.: PCT/JP90/00847

§ 371 Date: Dec. 20, 1991

§ 102(e) Date: Dec. 20, 1991

[87] PCT Pub. No.: WO91/00497

PCT Pub. Date: Jan. 10, 1991

[30] Foreign Application Priority Data

Jun. 30, 1989 [JP] Japan ..... 1-170422

[51] Int. Cl.[5] ..... E21B 47/09; G01V 3/00; G01B 7/14; E21D 9/06

[52] U.S. Cl. ..... 324/326; 175/45; 324/207.17; 324/334; 364/449

[58] Field of Search ..... 324/67, 207.17, 207.26, 324/326, 345, 346, 334, 359; 33/304, 312, 313; 175/26, 45, 61; 340/551; 342/459; 364/424.02, 449

[56] References Cited

U.S. PATENT DOCUMENTS

| | | | |
|---|---|---|---|
| 3,529,682 | 9/1970 | Coyne et al. | 340/551 X |
| 3,712,391 | 1/1973 | Coyne | 175/45 X |
| 3,907,045 | 9/1975 | Dahl et al. | 175/45 |
| 4,875,014 | 10/1989 | Roberts et al. | 324/346 X |

FOREIGN PATENT DOCUMENTS

| | | |
|---|---|---|
| 62-5114 | 1/1987 | Japan . |
| 62-5115 | 1/1987 | Japan . |
| 62-5116 | 1/1987 | Japan . |
| 62-5117 | 1/1987 | Japan . |
| 62-5118 | 1/1987 | Japan . |
| 62-5119 | 1/1987 | Japan . |
| 62-5120 | 1/1987 | Japan . |
| 62-5121 | 1/1987 | Japan . |
| 62-169012 | 7/1987 | Japan . |
| 63-42492 | 2/1988 | Japan . |
| 63-120219 | 5/1988 | Japan . |

*Primary Examiner*—Gerard R. Strecker
*Attorney, Agent, or Firm*—Richards, Medlock & Andrews

[57] ABSTRACT

A position measuring apparatus easily and accurately detects the position of an underground excavator, such as a shield excavator, during the underground excavation, and particularly the position thereof on a horizontal plane. The position measuring apparatus comprises a transmitter (10) including at least two cable loops (10*a*, 10*b*) which generate AC magnetic fields; a receiver (30) which detects the AC magnetic fields and produces signals representative of the detected fields; and a computing unit (60) which identifies the signals with respect to the originating cable loop and which calculates the position of the underground excavator (20). The two cable loops (10*a*, 10*b*) are substantially perpendicular to each other. The receiver (30) includes two magnetic field detecting elements ($S_1$, $S_2$) which are substantially perpendicular to each other. The receiver (30) is rotatably driven so as to maintain the magnetic field detecting elements ($S_1$, $S_2$) at constant angles to the cable loops (10*a*, 10*b*).

20 Claims, 4 Drawing Sheets

APPARATUS HAVING A PAIR OF MAGNETIC FIELD GENERATING CABLES FOR MEASURING POSITION OF AN UNDERGROUND EXCAVATOR

FIELD OF THE INVENTION

The present invention relates to a position measuring apparatus of an underground excavator and, more particularly, to a position measuring apparatus of an underground excavator such as a shield machine which excavates underground.

BACKGROUND ART

Conventional methods of location survey for driving a shield machine used in the shield tunneling method include: a method in which the inside of a tunnel is surveyed with a transit or the like; and a method in which an optical oscillating device for generating a coherent light such as a laser beam is provided inside a vertical shaft of a shield machine, and in which the device emits the light along the planned tunnel line, and then the light spot on a target provided in the shield machine is read, and thus displacement and deflection angle of the shield machine are measured. In still another method, the position of the machine relative to a reference position is obtained with combinations of a direction gyro and a pressure-type subsidence recorder, and of a clinometer and driving distance recorder (referring to length of a segment). Further, the inventor has proposed (in Japanese Patent Laid-Open No. 62-169012) a method in which a magnetic field generating cable is provided on the ground surface and a magnetic field detecting element is provided in an underground excavator, and in which a magnetic field generated from the cable is detected by the detecting element and thus displacement in the horizontal position of the underground excavator is measured.

However, in a case where the inside-tunnel survey method employing a transit or the like is used to survey a to-be-bored tunnel which is curved or bent, many station points are required, increasing the number of work stages. Thus, such a method is not practical. If the method employing a laser beam is used to survey a curved or bent tunnel, the laser beam may not reach a target in some cases. In such cases, an optical oscillating device has to be moved to an appropriate position. Further, if a planned tunnel line is curved or bent, because, in such a case, a light beam can not directly irradiate the planned line, the displacement and deflection angle of the shield machine are usually obtained by measuring distances and angles between the target, the oscillating device and the planned tunnel line and by calculating from such measurements the positions thereof relative to one another. Therefore, extra work stages are required for the transposition of an oscillating device, the measurement and the calculation, and thus excavating efficiency decreases. A method employing a gyro has a problem in that because accumulated error becomes large, it is not suitable for a long-distance excavation. Further, a method employing a magnetic field has a problem in that though it measures horizontal displacement, it cannot measure excavating distance (such as a distance of excavation from a vertical shaft).

It is an object of the present invention to solve the above-mentioned problems by providing a position measuring apparatus of an underground excavator which easily and accurately measures the position on a horizontal plane or the like of a shield machine or the like which is excavating underground.

SUMMARY OF THE INVENTION

The first aspect of the present invention provides a position measuring apparatus comprising: a transmitter including at least two cables which are provided under or on the ground and around which AC magnetic fields are generated by electricity from an AC power source; a receiver which receives the AC magnetic fields; and a computing unit which identifies signals from the receiver and which calculates the position of the underground excavator. The second aspect of the present invention provides a position measuring apparatus in which the planes of the two cables are substantially perpendicular to each a two other. The third aspect of the present invention provides a position measuring apparatus in which the receiver includes two magnetic field detecting elements which are substantially perpendicular to each other. The fourth aspect of the present invention provides a position measuring apparatus in which the receiver is supported by a receiver supporting device which rotates, according to signals from a direction detecting device, so as to maintain these elements at specified angles to the two cables. Further, the fifth aspect of the present invention provides a position measuring apparatus comprising a timing output circuit which controls the application of power to the two cables so that AC magnetic fields are generated alternately from the two cables.

In a position measuring apparatus constructed as described above, the magnetic fields generated by supplying AC currents to at least two cables provided on or under the ground are received by the two magnetic field detecting elements which intersect each other at a specified angle on the receiver supporting device which is controlled so as to face in a constant direction, and such magnetic field reception by these elements provides a level of voltage, by which the position on a horizontal plane of an underground excavator is easily and accurately detected.

A position measuring apparatus as described above may include two more cables and another receiver, so that it can measure depth. The depth may also be measured by a conventional pressure-type subsidence recorder or a combination of a clinometer and a driving distance recorder.

THE BEST MODE FOR CARRYING OUT THE INVENTION

The principle of a horizontal position detection according to the present invention will be described with reference to FIGS. 4, 5.

Figure 4:
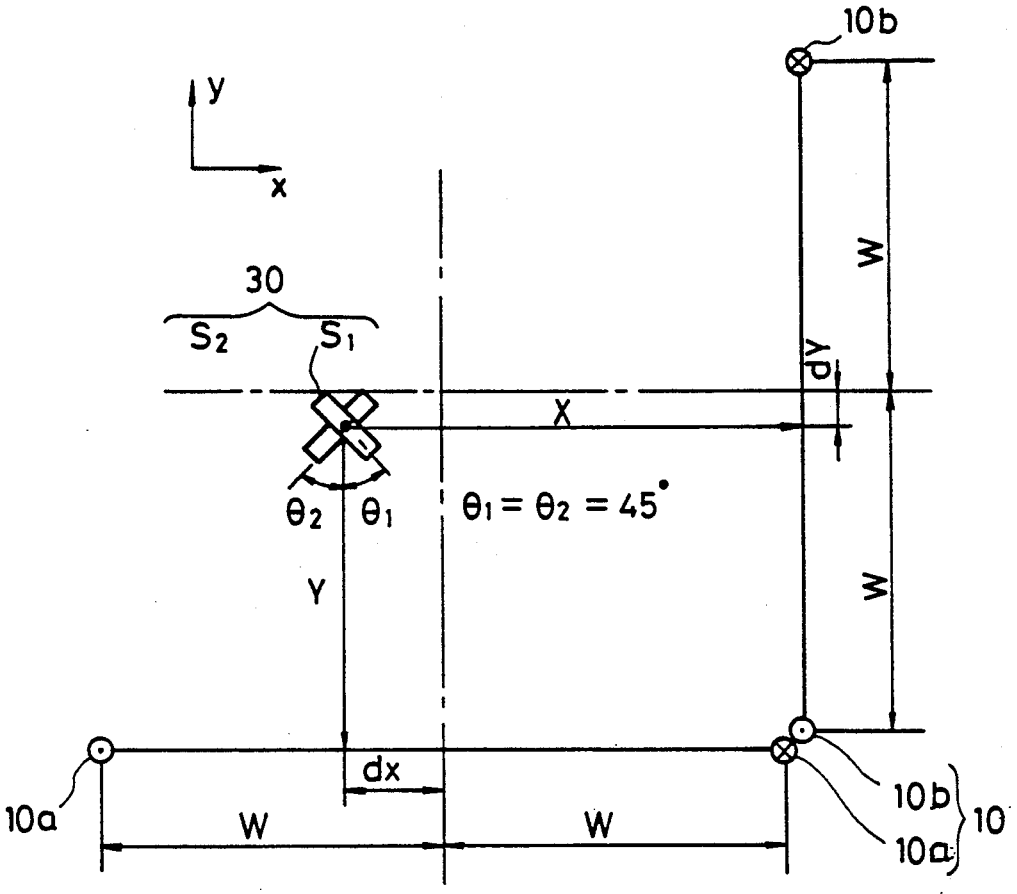
FIGS. 4 and 5 are schematic drawings illustrating the principle of horizontal position detection according to the present invention.

FIG. 4 is a schematic plan view. In the figure, two cables 10 formed in rectangular loops are provided vertically underground. A cable 10*a* is located in a vertical X-Z plane which is parallel to the horizontal direction of excavation (X-axis). The other cable 10*b* is located in a vertical Y-Z plane which is perpendicular to the direction of excavating and substantially perpendicular to the plane of the loop of cable 10*a*. One side of the loop of cable 10*a* touches one side of the loop of cable 10*b*. A receiver 30 has two magnetic field detecting elements $S_1$, $S_2$ whose magnetic field detecting directions intersect perpendicularly and are angled at 45° to vertical planes of the cables 10*a*, 10*b*.

Figure 5:
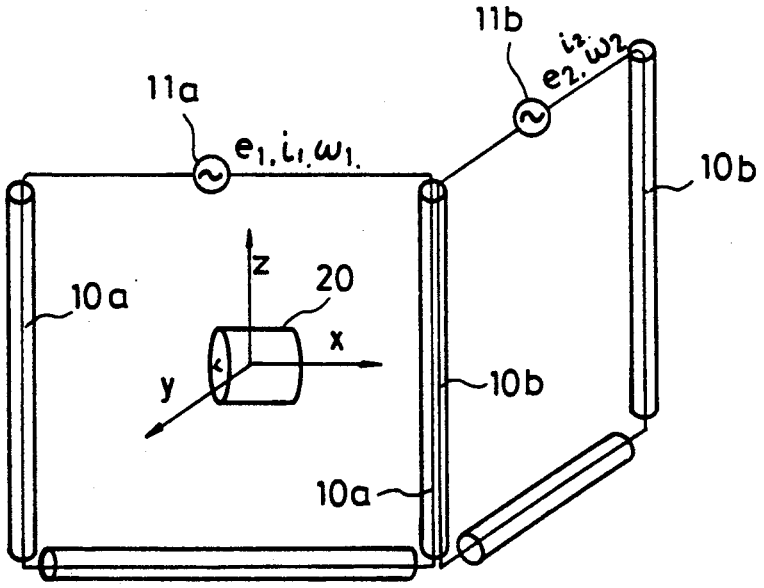

FIG. 5 is a schematic perspective view of what is shown in FIG. 4. An AC power source 11*a* supplies the cable 10*a* with voltage $e_1$, current $i_1$ and frequency $\omega_1$, and another AC power source 11*b* supplies the cable 10*b* with voltage $e_2$, current $i_2$ and frequency $\omega_2$.

Under these conditions, parameters are determined as follows:

- 2W: distance between two vertical legs of the cable 10*a*, and distance between two vertical legs of the cable 10*b*
- X: distance of the magnetic field detecting elements $S_1$ and $S_2$ from the plane of the loop of cable 10*b*
- Y: distance of the magnetic field detecting elements $S_1$ and $S_2$ from the plane of the loop of cable 10*a*
- dX: horizontal displacement of the magnetic field detecting elements $S_1$ and $S_2$ from the horizontal center of the loop of cable 10*a*
- dY: horizontal displacement of the magnetic field detecting elements $S_1$ and $S_2$ from the horizontal center of the loop of cable 10*b*
- $\theta_1$: angle between the magnetic field detecting element $S_1$ and a line perpendicular to the plane of the loop of cable 10*a*
- $\theta_2$: angle between the magnetic field detecting element $S_2$ and a line perpendicular to the plane of the loop of cable 10*a*
- $V_{11}$: voltage induced in the magnetic field detecting element $S_1$ by the cable 10*a*
- $V_{21}$: voltage induced in the magnetic field detecting element $S_2$ by the cable 10*a*
- $V_{12}$: voltage induced in the magnetic field detecting element $S_1$ by the cable 10*b*
- $V_{22}$: voltage induced in the magnetic field detecting element $S_2$ by the cable 10*b*

The horizontal displacement of the receiver 30 from the X-axis center of the loop of cable 10*a* is obtained as:

$$dX=\{(V_{11}-V_{21})/(V_{11}+V_{21})\}\times(Y/2)$$

The horizontal displacement of the receiver 30 from the Y-axis center of the loop of cable 10*b* is obtained as:

$$dY=\{(V_{12}-V_{22})/(V_{12}+V_{22})\}\times(X/2)$$

The horizontal distances of the receiver 30 of an underground excavator 20 from the cables 10*a*, 10*b* are expressed as:

$$X=W+dX$$

$$Y=W+dY$$

Thus, $$X=\{(1+A)/(1-AB)\}\times W$$

$$Y=\{(1+B)/(1-AB)\}\times W$$

where $$A=(V_{11}-V_{21})/(V_{11}+V_{21})$$

$$B=(V_{12}-V_{22})/(V_{12}+V_{22})$$

Although the cable 10*a* and the cable 10*b* have the same distance between their vertical legs (2W) and one side of the loop of cable 10*a* touches one side of the loop of cable 10*b* in the above example, the horizontal distance of each loop from the receiver 30 on the underground excavator can naturally be obtained if the between-leg distances of the two cables 10*a*, 10*b* are different from each other and the sides of the cable loops which are touched in the above example are separated or intersected.

Figure 1:
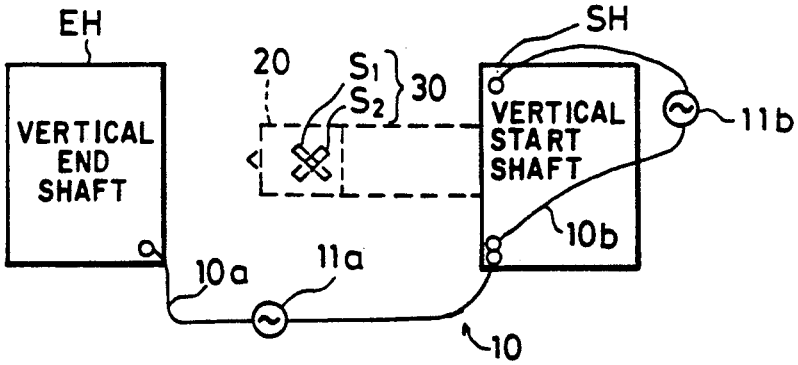
FIG. 1 is a schematic plan view of a position measuring apparatus of an underground excavator according to the present invention.
Figure 2:
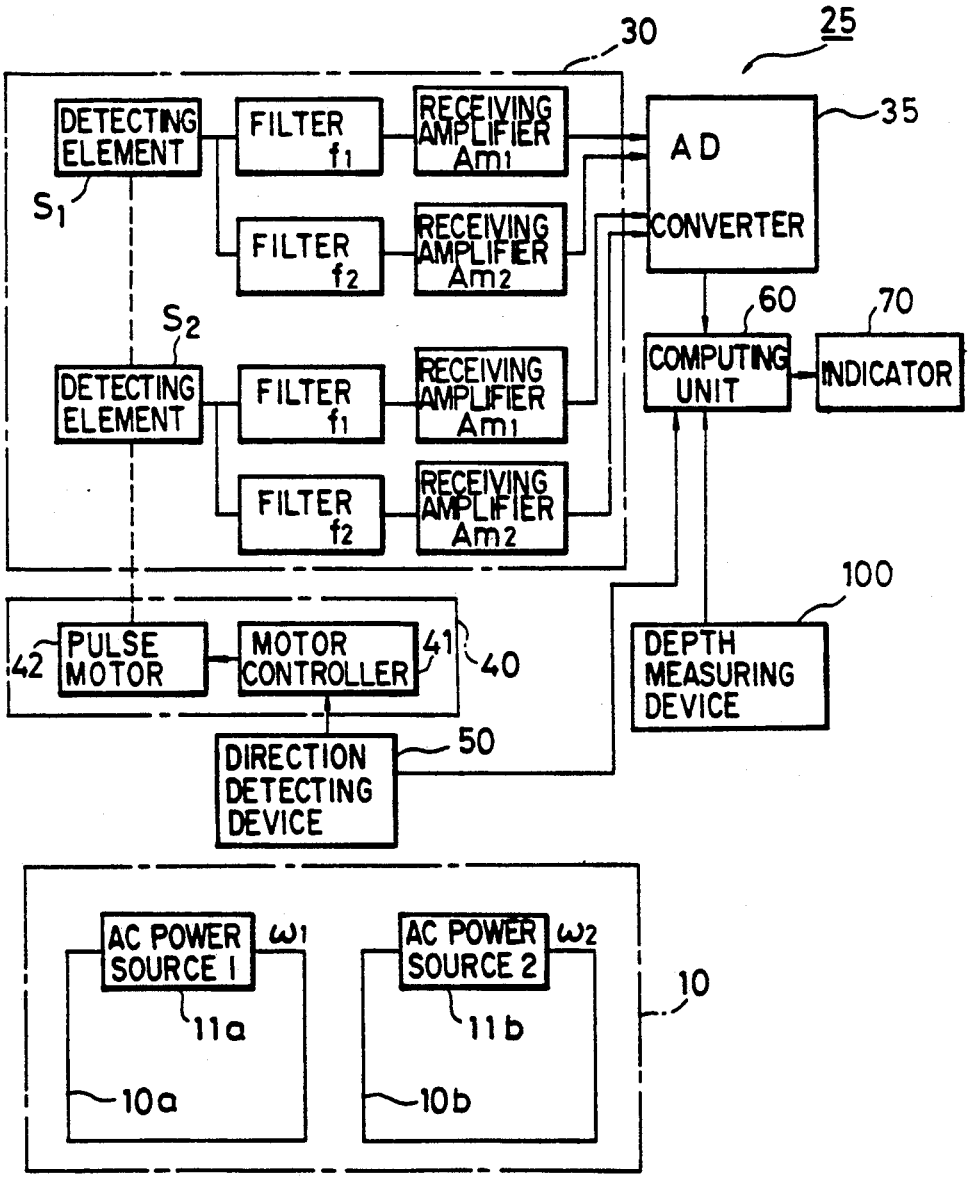
FIG. 2 is a block diagram of a position measuring apparatus according to the first embodiment of the present invention.

FIG. 1 shows a plan view of a position measuring apparatus 25 of an underground excavator 20 according to the present invention constructed on the basis of the above described principle. FIG. 2 shows a detailed block diagram of the position measuring apparatus. The figures show: a vertical start shaft SH; a vertical end shaft EH; a transmitter 10 including two cables, one being a cable 10*a* provided with one of its vertical legs in the vertical start shaft SH and its other vertical leg in the vertical end shaft EH, and the other being a cable 10*b* provided with both of its vertical legs inside the vertical start shaft SH; an underground excavator 20; a receiver 30 carried by the underground excavator 20 and including two magnetic field detecting elements $S_1$ and $S_2$ whose magnetic detecting directions are perpendicular to each other; an analog-to-digital converter 35; and a receiver supporting device 40 which rotates according to signals from a direction detecting device 50 in order to position the receiver 30 at a certain angle to the two transmitting loops. The direction detecting device 50 detects the direction in which the underground excavator 20 is driven, and controls the rotation of the receiver supporting device 40. A computing unit 60 calculates the position of the underground excavator 20 based on signals which the device 60 receives. An indicator 70 indicates the position of the underground excavator 20 according to the calculations by the computing unit 60. A depth measuring device 100 employs a pressure-type subsidence recorder or the like, according to this embodiment, to measure depth (Z-axis). The loop of cable 10*a* and the loop of cable 10*b* of the transmitter 10 are perpendicular to each other and are supplied with power by AC power sources 11*a* and 11*b* respectively.

The receiver 30 includes: two magnetic field detecting elements $S_1$ and $S_2$; each element having a respective pair of filters $f_1$ and $f_2$ connected thereto; and two pairs of receiving amplifiers $Am_1$ and $Am_2$, with each amplifier being connected to a respective one of the filters $f_1$, $f_2$. The receiver 30 is connected through the AD converter 35 to the computing unit 60. The receiver supporting device 40 is rotated by a pulse motor 42 which is controlled by a motor controller 41 according to the signals from the direction detecting device 50, in order to maintain the positions of the magnetic field detecting elements $S_1$, $S_2$ or the like at constant angles. The magnetic field detecting elements $S_1$, $S_2$ are placed on a table (not shown).

Operation of the position measuring apparatus constructed as described above will be described. The AC power source 11*a* supplies the cable 10*a* with an AC current at a frequency $\omega_1$. The AC power source 11*b* supplies the cable 10*b* with an AC current at a frequency $\omega_2$. The AC currents thus generate magnetic fields around the cables 10*a* and 10*b*. The magnetic fields are detected by the magnetic field detecting elements $S_1$ and $S_2$. The filters $f_1$ and $f_2$ determine from which cable the magnetic field inducing the voltage in each of the magnetic field detecting elements originated. The signals from the filters $f_1$ and $f_2$ are amplified by the respective receiving amplifiers $Am_1$ and $Am_2$. Then, the amplified signals are converted into digital values by the AD converter 35. The computing unit 60 performs the calculation described above based on these signals, and obtains X and Y-coordinates of the position of the receiver 30 of the underground excavator 20. The computing unit 60 also controls the receiver supporting device 40, according to the signals from the direction detecting device 50, so that the two magnetic fields detecting elements $S_1$ and $S_2$ will be at constant angles.

Figure 3:
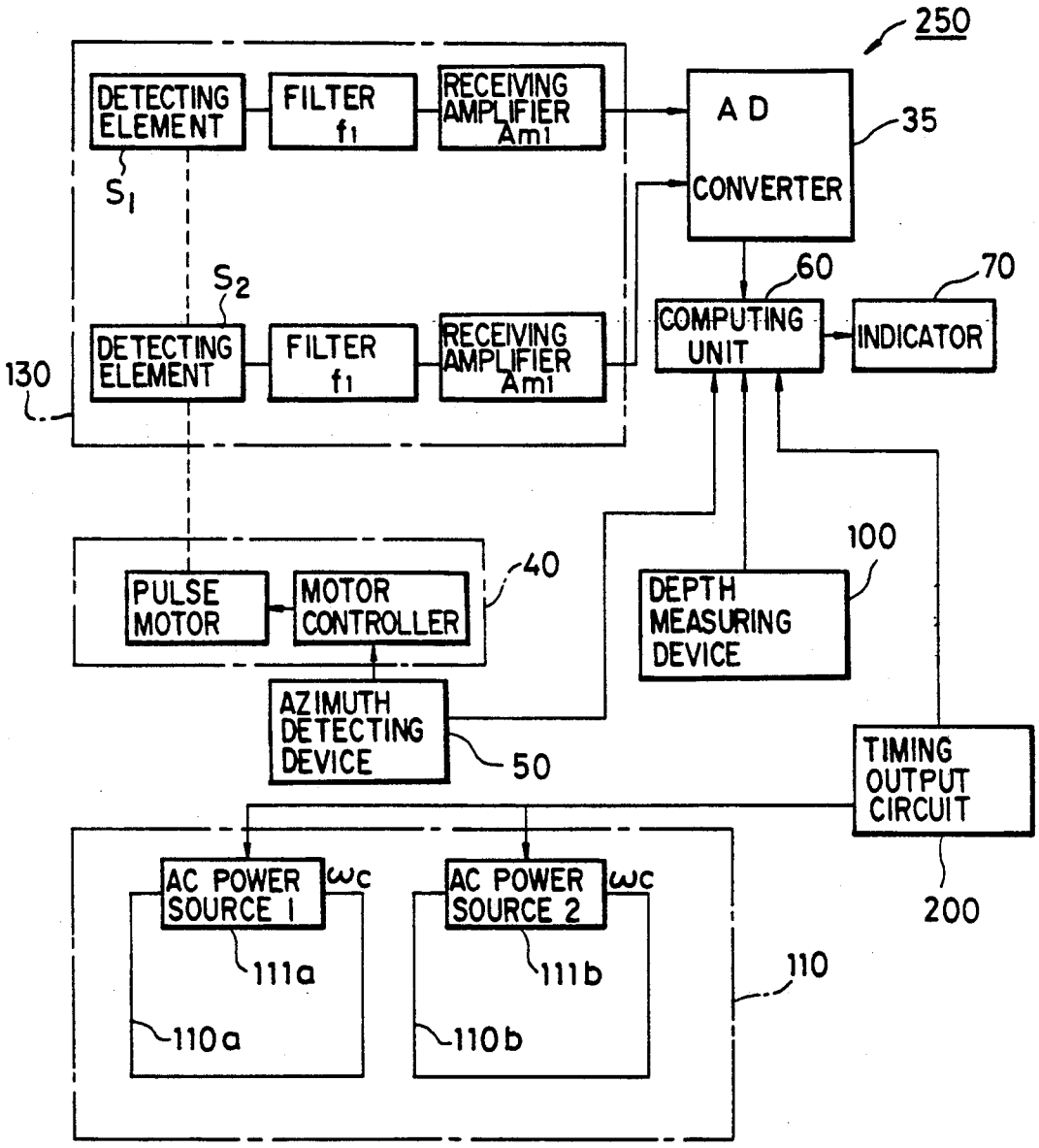
FIG. 3 is a block diagram of a position measuring apparatus according to the second embodiment of the present invention.

FIG. 3 is a block diagram of a position measuring apparatus 250 of an underground excavator 20 according to the second embodiment of the present invention. The parts equivalent to those of the first embodiment are denoted by the same numerals as in the first embodiment, and the description thereof will not be repeated.

Two cables 110*a* and 110*b* of a transmitter 110 are positioned with their loops substantially perpendicular to each other, and are alternately, according to signals from a timing output circuit 200, supplied with the same current (voltage $e_c$, current $i_c$, frequency $\omega_c$) from AC power sources 111*a* and 111*b*. A receiver 130 includes two magnetic field detecting elements, such as coils, $S_1$ and $S_2$; two filters $f_1$, each being connected to a respective one of these elements $S_1$ and $S_2$; two receiving amplifiers $Am_1$ connected to a respective filter $f_1$. The receiver 130 is connected through an AD converter 35 to a computing unit 60.

The operation of such a construction will be described. The AC power sources 111*a* and 111*b* supply current having a frequency $\omega_1$ to the cables 110*a* and 110*b* alternately according to the signals from the timing output circuit 200. AC magnetic fields are thus alternately generated in concentric configurations about cables 110*a* and 110*b*. The magnetics fields are detected by the magnetic field detecting elements $S_1$ and $S_2$. The detection signals are shaped by the filters $f_1$. Because the signals from the timing output circuit 200 are inputted to the computing unit 60, it can be determined from which cable the detected magnetic field originated.

Figure 6:
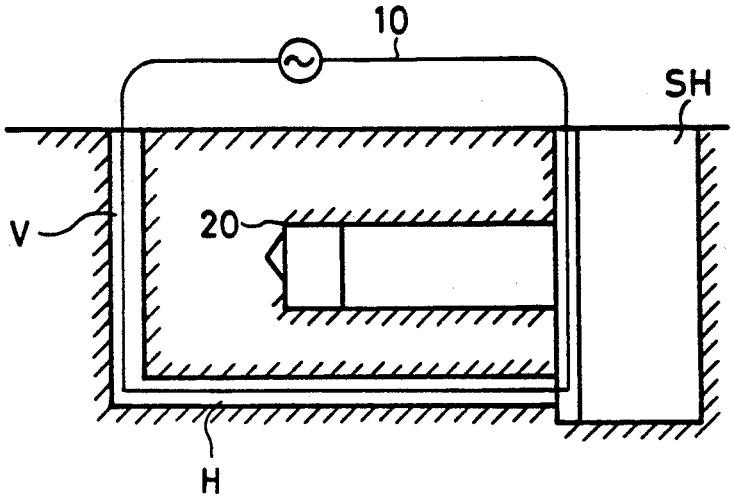
FIGS. 6 and 7 are schematic drawings showing exemplary placing of cables.
Figure 7:
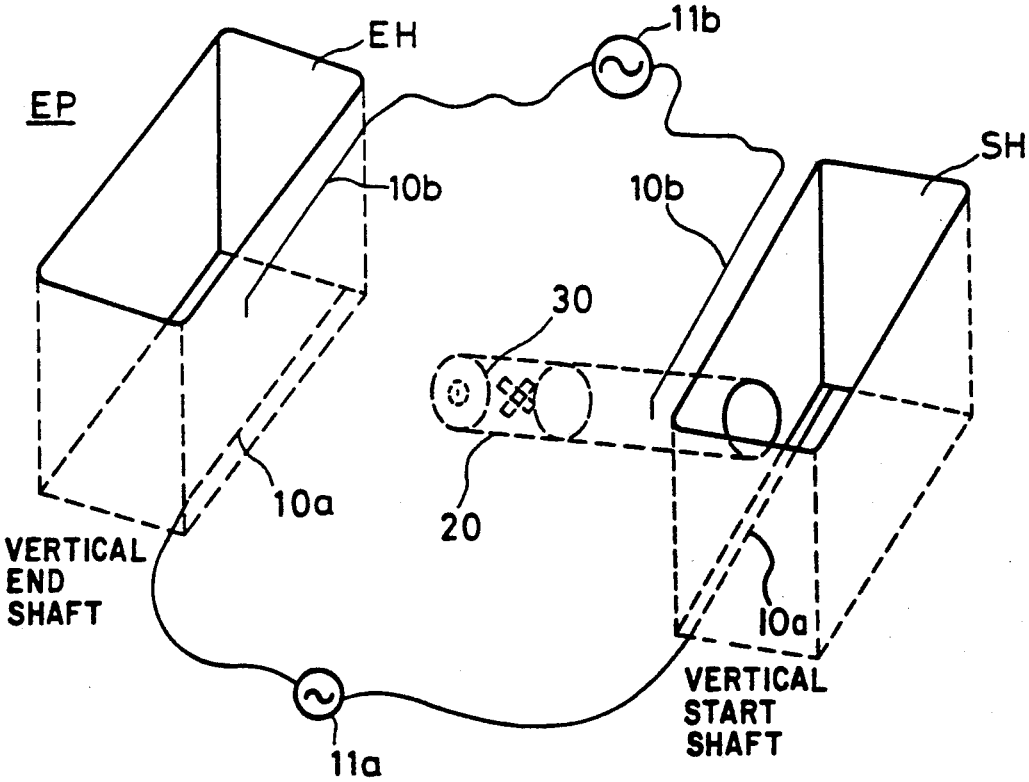

FIG. 6 illustrates an application of the present invention, wherein a horizontal shaft H is provided between a vertical start shaft SH and a vertical cable shaft V and a cable 10 is provided in these vertical shafts. FIG. 7 illustrates another application, wherein a cable 10*a* is provided underground between a vertical start shaft SH and a vertical end shaft EH and a cable 10*b* is provided on the ground surface EP therebetween.

A vertical shaft may be bored not only from the ground surface but from an underground portion of a building. In the case where vertical shafts are provided but no horizontal shafts, a cable may be grounded at a lower portion of a vertical shaft, providing similar effects to those in the above embodiments.

INDUSTRIAL APPLICABILITY

A position measuring apparatus according to the present invention advantageously detects automatically, continuously and instantaneously the horizontal position of an excavator, such as a shield machine, excavating underground.

Since the present invention can be realized by simply providing the necessary cables, a position measuring apparatus according to the present invention can be suitably used for boring a tunnel which is sharply curved or continuously curved with its depth varying greatly.

we claim:

1. A position measuring apparatus for measuring the position of an underground excavator in a horizontal plane, comprising: a transmitter (10) including at least two cables (10*a*), (10*b*) which are provided under or on the ground and around which AC magnetic fields are generated by electricity from an AC power source, one of said cables being in a first plane and another of said cables being in a second plane, said second plane being at least substantially perpendicular to said first plane; a receiver (30) which receives the AC magnetic fields from the transmitter (10), the position of said receiver (30) being associated with the position of said underground excavator (20); and a computing unit (60) which identifies signals from the receiver (30) and which calculates the position of the underground excavator (20) in said horizontal plane.

2. A position measuring apparatus of an underground excavator according to claim 1, wherein said first and second planes are vertical planes.

3. A position measuring apparatus of an underground excavator according to claim 1, wherein said receiver (30) includes two magnetic field detecting elements ($S_1$), ($S_2$) which are positioned so that the directions in which the elements ($S_1$), ($S_2$) detect the AC magnetic fields from the two cables (10*a*), (10*b*) of the transmitter (10) are substantially perpendicular to each other.

4. A position measuring apparatus of an underground excavator according to claim 3, wherein said receiver (30) is supported by a receiver supporting device (40) which rotates, according to signals from a direction detecting device (50), so as to always maintain said two elements ($S_1$), ($S_2$) at specified angles to the two cables (10*a*), (10*b*).

5. A position measuring apparatus of an underground excavating apparatus according to claim 1, wherein a timing output circuit (200) is provided between said transmitter (10) and said computing unit (60) and the timing output circuit (200) provides signals whereby two cables (10*a*), (10*b*) alternately receive AC currents so that AC magnetic fields are generated alternately around the cables (10*a*), (10*b*).

6. A position measuring apparatus of an underground excavator according to claim 1, wherein said receiver (30) is supported by a receiver supporting device (40) which rotates, according to signals from a direction detecting device (50), so as to always maintain said two elements ($S_1$, $S_2$) at specified angles to the two cables (10*a*), (10*b*).

7. A position measuring system for determining the position of an underground excavator in a horizontal plane, said system comprising:

a first cable forming at least a substantial portion of a first loop and associated with the ground to produce a first alternating magnetic field in the ground upon the application of an alternating current to said first cable, a second cable forming at least a substantial portion of a second loop and associated with the ground to produce a second alternating magnetic field in the ground upon the application of an alternating current to said second cable, said first and second loops being positioned at least substantially perpendicular to each other, a magnetic field detector for detecting said first and second alternating magnetic fields and producing signals representative thereof, said magnetic field detector being associated with the position of said underground excavator, and a computing unit connected to receive said signals from said magnetic field detector and to use said signals to calculate the position of said underground excavator in said horizontal plane.

8. A position measuring system in accordance with claim 7, wherein said first and second loops are positioned in vertical planes which are at least substantially perpendicular to each other.

9. A position measuring system in accordance with claim 7, wherein said magnetic field detector comprises a first magnetic field detecting element and a second magnetic field detecting element, said first and second magnetic field detecting elements being positioned at least substantially perpendicular to each other.

10. A position measuring system in accordance with claim 9, wherein said first and second loops are positioned in vertical planes which are at least substantially perpendicular to each other, and wherein at least a part of one of said loops is underground.

11. A position measuring system in accordance with claim 10, further comprising a first source of alternating current connected to said first loop to apply to said first loop alternating current of a first frequency, and a second source of alternating current connected to said second loop to apply to said second loop alternating current of a second frequency, said second frequency being different from said first frequency.

12. A position measuring system in accordance with claim 11, wherein said magnetic field detector further comprises first and second filters connected to said first magnetic field detecting element for distinguishing signals resulting from said first magnetic field from signals resulting from said second magnetic field, and third and fourth filters connected to said second magnetic field detecting element for distinguishing signals resulting from said first magnetic field from signals resulting from said second magnetic field.

13. A position measuring system in accordance with claim 12, further comprising a depth measuring device for determining the depth of said underground excavator.

14. A position measuring system in accordance with claim 12, further comprising means for rotating said magnetic field detector so as to maintain a predetermined angular relationship of said magnetic field detector and said first and second loops.

15. A position measuring system in accordance with claim 10, further comprising means for alternately applying current to said first and second loops.

16. A position measuring system in accordance with claim 15, wherein said means for alternately applying current comprises a timer and at least one source of alternating current, whereby said timer provides for the application of alternating current to said first loop during a first time interval and then the application of alternating current to said second loop during a second time interval so that said first and second magnetic fields are alternately produced.

17. A position measuring system in accordance with claim 15, wherein said means for alternately applying current comprises a timer, a first source of alternating current of a first frequency, and a second source of alternating current of a second frequency, said second frequency being the same as said first frequency, whereby said timer provides for the application of alternating current from said first source to said first loop during a first time interval and then the application of alternating current from said second source to said second loop during a second time interval so that said first and second magnetic fields are alternately produced.

18. A position measuring system in accordance with claim 17, further comprising a depth measuring device for determining the depth of said underground excavator.

19. A position measuring system in accordance with claim 18, further comprising means for rotating said magnetic field detector so as to maintain a predetermined angular relationship of said magnetic field detector and said first and second loops.

20. A position measuring system in accordance with claim 7, further comprising a depth measuring device for determining the depth of said underground excavator.

* * * * *